United States Patent [19]

Pelura

[11] 4,373,292

[45] Feb. 15, 1983

[54] DUAL CHARACTER DOLL

[75] Inventor: Carme D. Pelura, Pennsville, N.J.

[73] Assignee: Neat Nap, Inc., Pennsville, N.J.

[21] Appl. No.: 257,361

[22] Filed: Apr. 24, 1981

[51] Int. Cl.[3] ..... A63H 3/12

[52] U.S. Cl. ..... 46/153; 46/DIG. 1

[58] Field of Search ..... 46/153, 151, DIG. 1, 46/158, 156, 162, 22

[56] References Cited

U.S. PATENT DOCUMENTS

| | | | |
|---|---|---|---|
| 1,336,898 | 4/1920 | Flynn | 46/151 |
| 1,425,974 | 8/1922 | Kearney | 46/153 |
| 1,434,930 | 11/1922 | Taylor | 46/153 |
| 3,789,547 | 2/1974 | Chemarin | 46/158 |
| 3,791,068 | 2/1974 | Pietrowiak | 46/153 X |
| 4,249,337 | 2/1981 | Edson | 46/153 |

*Primary Examiner*—Mickey Yu

*Attorney, Agent, or Firm*—Mortenson & Uebler

[57] ABSTRACT

A new doll is provided, being a dual character doll and having fasteners for joining to a second, similar dual character doll at or near the hands. Any number of such dolls may be joined together to produce a family, including a neighborhood family, such as fireman, policeman, doctor or nurse. In a preferred embodiment, the fasteners at each hand are pads of the hook and loop type, at each hand there being at least two pads, one of the hook type and one of the loop type. In this manner, any such doll can be joined to any other, similar doll.

9 Claims, 4 Drawing Figures

Fig. 1.
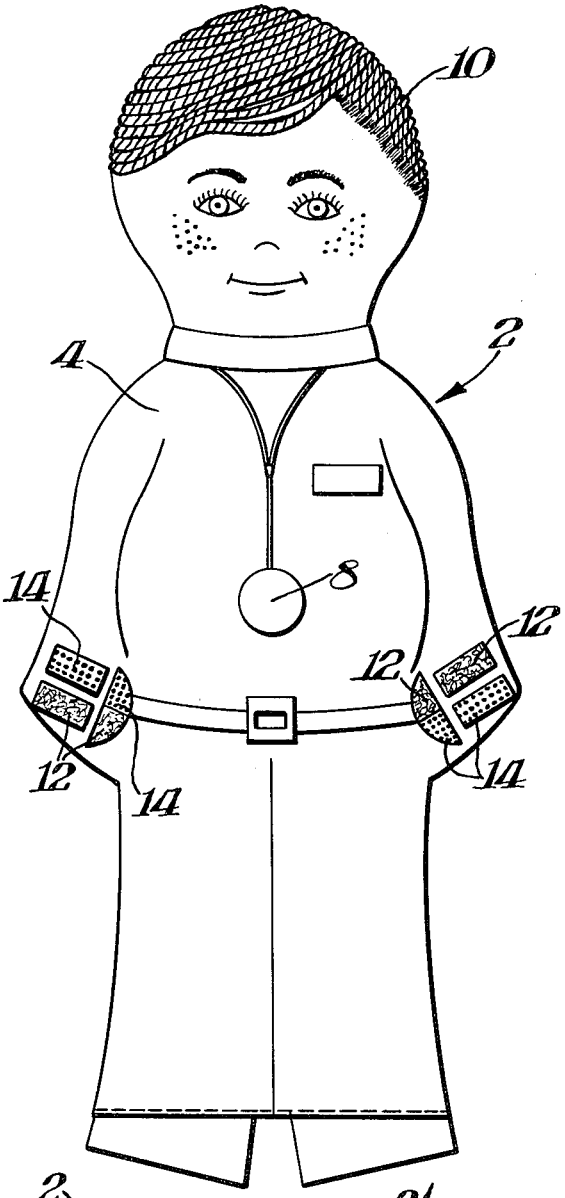
Fig. 2.
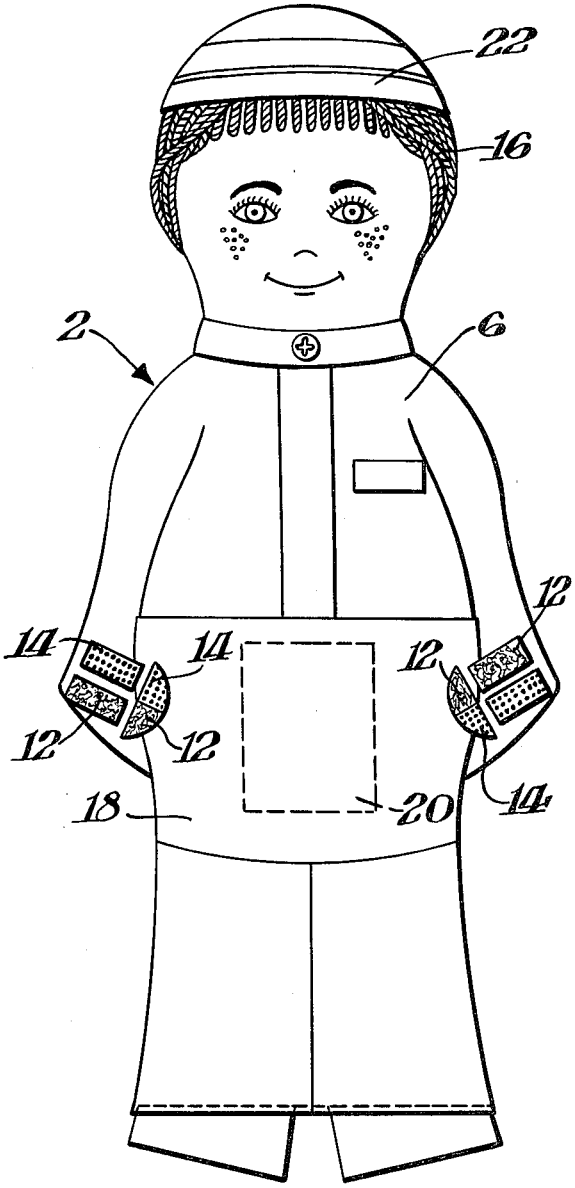
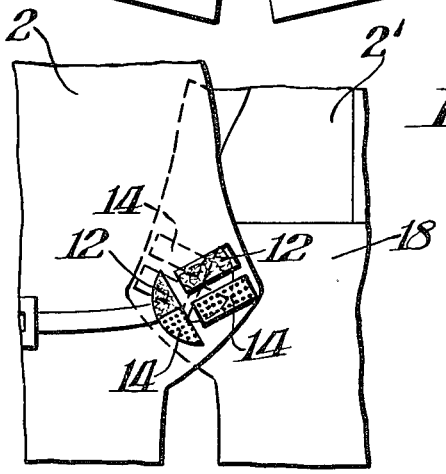
Fig. 4.

DUAL CHARACTER DOLL

BACKGROUND OF THE INVENTION

The present invention relates to dual character dolls having fastening means located at the hands thereof enabling such dolls to be attached to other, similar dolls to form a family.

Dual character dolls are known. U.S. Pat. No. 3,791,068 discloses a dual face illuminated doll preferably made of a transluscent flesh colored resilient plastic material, having a hollow body, legs and arms, and a plurality of interchangeable heads representing an assortment of different persons. The body is provided with electric power means for lighting a bulb which is mounted on the neck of the body and extends into the hollow of any head that might be mounted thereon. Upon switching on the light, the head glows more or less brightly depending on the power of the light bulb and the transparency of the flesh colored plastic material. The dual characters disclosed include doctor, nurse, mother, sister or brother, or other persons.

Other patents which disclose dual faced dolls include U.S. Pat. Nos. 1,289,715 and 1,099,208.

U.S. Pat. No. 4,249,337 discloses a breast feeding doll set comprising a mother doll and a baby doll. The mother doll is provided with complimentary fasteners on the extremities of the arms to lock the arms about the baby doll to hold the baby doll against the mother doll. The fasteners may be Velcro® hook and loop type fasteners, snaps or other suitable fastening means.

Play, to a child, may be defined as the child's mode of expression. An adult may view a child's non-verbal play to gain insight into the child's unconscious and his perceptions about life as he mimics the behavior of adults and actual events.

The dominant theme of a child's pre-school play is Dramatic Play, i.e. the taking on of roles and the acting out of themes drawn from the child's immediate environment. As the child recognizes his expanding universe, his play themes grow to encompass that universe and to include his fantasies.

Dramatic Play is an important source for learning role identification. This play is often modeled from the behavior of familiar adults. During this type of play the child can use his "power" to design, change and influence his environment. Since he has always been subjected to the approaches and behavior of others, this "power" gives him a new sense of freedom and autonomy.

As the child constructs scenes during play, he may reveal his perceptions of his environment. Because the child's environment is dictated to a large extent by his extended family, it is reasonable to conclude that he feels a variety of emotions towards these people. For this reason, a family of dolls would act as a tool in the child's expression of his feelings. By owning a doll family, the child will be able to act out these incidents with all the significant players at hand.

A family of dolls can be used as an educational tool for reinactment of proposed, present or past events. For example, psychological research has proven that children may exhibit their controlled personalities (fear, hostility, conflict, love) by transference of these feelings to those "dolly" is experiencing.

For example, a mother preparing her child for a medical procedure may help the child express his feelings by watching his play with a nurse and/or doctor doll.

Acting as the dolls' voices, parents can explain medical procedures and events that will happen to the child through a doll and see and hear how the child reacts. The child may want to perform a procedure on the dolls also, i.e. give the doctor doll a shot.

Children who are most likely to have emotional problems from experiences like this are those who fail to establish positive relations with the nurse and doctor, who withdraw from the situation or react with panic to it because they can't express their feelings about the invasive procedure or medical environment.

SUMMARY OF THE INVENTION

A dual character doll is provided having fastening means for joining to a second, similar dual character doll at or near te hands thereof.

A family of dolls is provided wherein a first doll is joined at one hand to one hand of a second, similar doll, the second hand of the second doll joined to one hand of a third, similar doll, and so on to an nth doll, the second hand of the nth doll joined to the second hand of the first doll wherein n can be any number greater than 2, to form a family circle of dolls.

Preferred fastening means comprise pads affixed near the hands thereof, the pads being of the hook and loop type, at each hand there being at least two pads, one such being of the hook type and one being of the loop type. In this way, each such doll can be attached at either hand to either hand of any other similar doll in this collection.

The dual characters can be doctor/nurse, mother/father, boy/girl, grandmother/grandfather, fireman/policeman or any other desired combination.

BRIEF DESCRIPTION OF THE DRAWINGS

FIG. 1 is a front elevational view of the doll of this invention.

FIG. 2 is a rear elevational view of the doll of this invention.

FIG. 4 is a fragmentary view of two similar dolls of this invention joined together at the hands.

Figure 3:
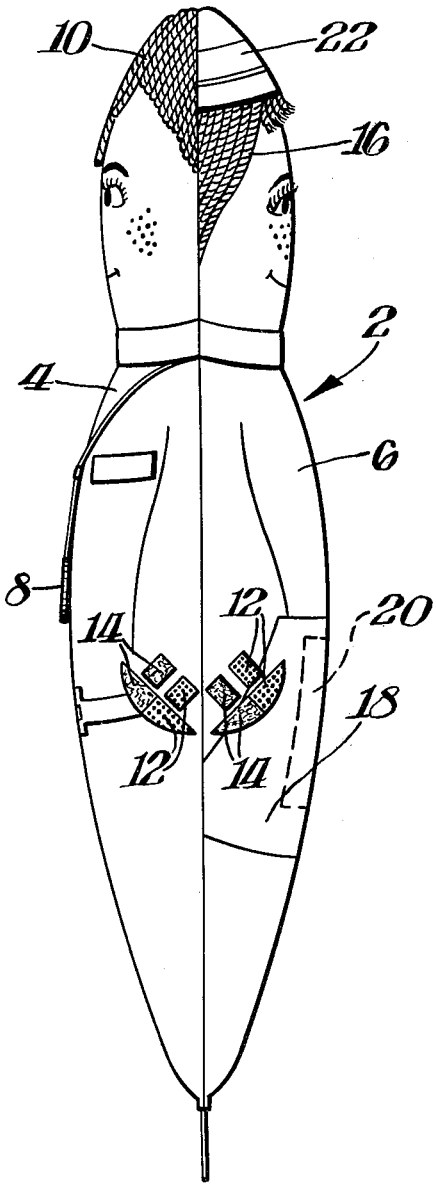
FIG. 3 is a side elevational view of the doll of this invention.

DETAILED DESCRIPTION OF THE INVENTION AND PREFERRED EMBODIMENTS WITH REFERENCE TO THE DRAWINGS

A new family doll is provided, being a dual character doll and having fastening means for joining to a second, similar dual character doll at or near the hands. Any number of such dolls may be joined together to produce a family, including a neighborhood family such as fireman, policeman, doctor or nurse. In a preferred embodiment, the fastening means at each hand are pads of the hook and loop type, at each hand there being at least two pads, one of the hook type and one of the loop type. In this manner, any such doll can be joined to any other, similar doll.

As illustrated in the drawings by way of example the doll may be of the stuffed cloth covered type, in which case the doll may also be used as a pillow. In such embodiment, the doll has soft parts with no removable objects and is stuffed with non-allergenic fibers.

The detailed description of the invention is best provided by reference to the drawings.

FIG. 1 shows a front elevational view of exemplary doll 2 of this invention. Doll 2 on the front face is shown to have the caricature and apparel of a doctor 4, including stethoscope 8 and yarn hair 10. At each hand of the doctor side of doll 2 are fastening means 12 and 14. Preferred fastening means 12 and 14 are the hook and loop fasteners (VELCRO®), wherein 12 is illustrated to be of the hook type and 14 is illustrated to be of the loop type. At each hand, at least one hook type fastener is used and at least one loop type fastener is used. In this way, universal fastening means are provided whereby the doll shown in FIG. 1 may be attached at either hand to another, similar doll, at either hand thereof, wherein said similar doll has similar fastening means. This feature is a key to the invention.

The two rectangular and two quarter-circular-shaped hook and loop type pads shown in FIG. 1 at each hand are presently preferred, but it will be clear to one skilled in the art that any number of other shapes of pads could be utilized. The essential requirement is that at least one hook type pad and at least one loop type pad be located at each hand of each side of each doll to provide for universal attachment to other, similar dolls.

FIG. 2 shows a rear elevation of doll 2 having nurse features 6. This illustration shows optional nurse's cap 22 and pocket 18 in the nurse's uniform into which document 20 and the like may be placed. Fastening means 12 and 14 are shown positioned at the hands of the nurse side of doll 2 and these fastening means are substantially the same as those on the reverse, doctor side of doll 2, previously described.

FIG. 3 shows a side elevational view of the doll of this invention. Therein, dual character doll 2 is shown to have doctor side 4 and nurse side 6. Various accessories can be provided such as stethoscope 8, pocket 18 for documents 20 and the like, and doctor's hair 10 and nurse's hair 16. The fastening means 12 and 14 on both the doctor side and the nurse side are shown in this illustration.

FIG. 4 shows a fragmentary view of a doll 2 and a similar doll 2′ in the region of the hands wherein the fastening means 12 and 14 of doll 2 are shown attached to fastening means 12 and 14 (in phantom) of doll 2′. Pocket 18 of doll 2′ is shown merely for completeness.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

I claim:

1. A dual character doll having front and back characters and having fastening means on both front and back characters for joining to a second, similar dual character doll at or near the hands thereof, wherein said fastening means comprise pads affixed near the hands thereof, said pads being of hook and loop type, at each fastening means location there being at least two pads, one such being of the hook type and one being of the loop type.

2. The doll of claim 1 joined at at least one hand to at least one second, similar doll.

3. The doll of claim 1 as a first doll joined at one hand to one hand of a seconds, similar doll, the second hand of said second doll joined to one hand of a third, similar doll, and so on to an nth doll, the second hand of the nth doll joined to the second hand of said first doll, wherein n can be any number greater than 2, to form a family circle of dolls.

4. The doll of claim 1 having at least one pocket affixed thereto for carrying notes and the like.

5. The dual character doll of claim 1, one character being a doctor and the second character being a nurse.

6. The dual character doll of claim 1, one character being a mother and the second character being a father.

7. The dual character doll of claim 1, one character being a boy and the second character being a girl.

8. The dual character doll of claim 1, one character being a grandmother and the second character being a grandfather.

9. The dual character doll of claim 1, one character being a fireman and the second character being a policeman.

* * * * *